US007089715B2

(12) United States Patent
Topf

(10) Patent No.: US 7,089,715 B2
(45) Date of Patent: Aug. 15, 2006

(54) BEVERAGE BOTTLING PLANT AND METHOD FOR FILLING BOTTLES INCLUDING A TREATMENT DEVICE FOR BEVERAGE CONTAINER CAPS

(75) Inventor: Roland Topf, Hamburg (DE)

(73) Assignee: KHS Maschinen- Und Anlagenbau AG, Dortmund (DE)

( * ) Notice: Subject to any disclaimer, the term of this patent is extended or adjusted under 35 U.S.C. 154(b) by 39 days.

(21) Appl. No.: 11/014,673

(22) Filed: Dec. 16, 2004

(65) Prior Publication Data

US 2005/0161110 A1 Jul. 28, 2005

(30) Foreign Application Priority Data

Dec. 18, 2003 (DE) ..... 103 59 392

(51) Int. Cl.
*B65B 55/10* (2006.01)
*B65B 1/03* (2006.01)

(52) U.S. Cl. ..... 53/426; 53/471; 53/141; 53/167; 53/281; 53/290; 198/637; 198/608

(58) Field of Classification Search ..... 53/426, 53/471, 141, 167, 281, 290; 198/635, 637, 198/638, 435, 608; B67B 1/03
See application file for complete search history.

(56) References Cited

U.S. PATENT DOCUMENTS 2,278,434 A * 4/1942 Fahey ..... 198/535
2,622,747 A * 12/1952 Bott ..... 198/637
3,595,375 A * 7/1971 Kaufmann et al. ..... 198/637

FOREIGN PATENT DOCUMENTS

| | | | |
|---|---|---|---|
| DE | 10238633 | | 1/2004 |
| FR | 2789065 | A1 * | 8/2000 |
| JP | 10085311 | A * | 4/1988 |
| JP | 11139416 | A * | 5/1999 |
| JP | 11342917 | A * | 12/1999 |
| JP | 2003128023 | A * | 5/2003 |
| WO | WO 9846486 | A1 * | 10/1998 |
| WO | WO 46142 | A1 * | 8/2000 |

* cited by examiner

*Primary Examiner*—Stephen F. Gerrity
(74) *Attorney, Agent, or Firm*—Nils H. Ljungman & Assciates

(57) ABSTRACT

A beverage bottling plant and method for filling bottles with a liquid beverage having a treatment device for beverage container caps. The treatment device for treating beverage container caps includes a first tower and a second tower provided with parallel axes and driven at the same peripheral speed. Transfer chutes are provided that emerge with their ends onto carrier rings of different towers, which chutes transfer caps from each tier of the first tower to a tier of the second tower, and from there, optionally via at least one additional tower and transfer chutes, to the next-lower tier of first tower.

20 Claims, 4 Drawing Sheets

BEVERAGE BOTTLING PLANT AND METHOD FOR FILLING BOTTLES INCLUDING A TREATMENT DEVICE FOR BEVERAGE CONTAINER CAPS

BACKGROUND

1. Technical Field

The present application relates to a beverage bottling plant for filling bottles with a liquid beverage, having a treatment device for treating beverage container caps.

2. Background Information

A beverage bottling plant for filling bottles with a liquid beverage filling material can possibly comprise a beverage filling machine with a plurality of beverage filling positions, each beverage filling position having a beverage filling device for filling bottles with liquid beverage filling material. The filling devices may have an apparatus designed to introduce a predetermined volume of liquid beverage filling material into the interior of bottles to a substantially predetermined level of liquid beverage filling material. The apparatus designed to introduce a predetermined flow of liquid beverage filling material further comprises an apparatus that is designed to terminate the filling of the beverage bottles upon the liquid beverage filling material reaching the predetermined level in bottles. There may also be provided a conveyer arrangement that is designed to move bottles, for example, from an inspecting machine to the filling machine. Upon filling, a closing station closes the filled bottles. There may further be provided a conveyer arrangement configured to transfer filled bottles from the filling machine to the closing station. Bottles may be labeled in a labeling station, the labeling station having a conveyer arrangement to receive bottles and to output bottles. The closing station and the labeling station may be connected by a corresponding conveyer arrangement.

A similar treatment device of the prior art is described in the subsequently published German Patent Application 10238633.1. A corresponding design was also previously disclosed by the publication of the brochure entitled "KHS Alfill Sterile CAP".

A device of this type is used to transport caps in a continuous, single-track or optionally also a multiple-track stream on a track for a relatively long period of time. The caps can be treated with a sterile gas during this period, for example, or before they enter the illustrated treatment device they can be treated with a treating fluid, such as $H_2O_2$ for example, which is vaporized in the device by the addition of air and heat. The continuous stream of caps must be treated in the device for a relatively long period of time, i.e. it must travel a relatively long distance.

The generic design of the prior art has a tower with carrier rings, whereby the transfer chutes connect carrier rings on different tiers of one and the same tower. Caps are thereby transported on a track in which they lie one behind the other alternately on carrier rings or transfer chutes. On the carrier rings, they are carried along by friction, i.e. driven, while they slide passively on the transfer chutes. As shown by the designs cited as the closest prior art, the transport is very smooth, and in particular no problems occur with jamming or backups.

In designs of the prior art, however, that can be said only for caps of a standard design, i.e. caps that have an essentially cylindrical basic shape. The fundamental problem is described below:

In the designs of the prior art, the transfer chutes are required to loop around the tower over a certain angle at circumference of 45°, for example, and therefore when viewed from overhead they run on a track that runs essentially in the circumferential direction. In addition, they must overcome the height difference from one tier to the next, which is determined essentially by the tallest cap that can be processed. Because the chutes must enter both carrier rings, at which they emerge with their rings, horizontally, the transfer chutes must have a downward curvature and a subsequent upward curvature in the vertical direction. In some areas, the surface of the transfer chutes must therefore be in the form of a helicoid surface.

Consequently, caps that lie one behind another on the transfer chute tip toward one another, and namely both around the axis of their direction of transport as well as around the transverse axis that runs perpendicular to the direction of transport. With caps that have a cylindrical basic shape, these mutual tipping movements do not cause major problems., But when the caps have a different basic shape, the caps become blocked and get stuck in the path that is described by the transfer chute, which has lateral boundaries.

Therefore, some shapes of caps that are extremely attractive for modern industrial applications cannot be processed using the devices of the prior art because of the danger of jamming. That is the case, in particular with sport caps, i.e. caps that have a built-in closure, a complicated shape and in particular a smaller diameter on the top than on the bottom. Even very flat caps, the basic shape of which is essentially that of a coin, of the type that are used, for example, as flat sealing caps underneath screw-on caps, cannot be processed, because their very low edges tend to ride over each other when they tip.

OBJECT OR OBJECTS

The object is therefore to significantly improve a treatment device of the type described above, so that caps of different shapes can be processed without the risk of jamming. The invention teaches that this object can be accomplished by a treatment device for treating beverage container caps characterized by the fact that a first tower and a second tower are provided with parallel axes and are driven at the same peripheral speed, whereby transfer chutes are provided that emerge with their ends onto carrier rings of different towers, which chutes transfer caps from each tier of the first tower to a tier of the second tower, and from there, optionally via at least one additional tower and transfer chutes, to the next-lower tier of the first tower.

SUMMARY

The present application teaches that this object can be accomplished by the features disclosed herein below.

The present application teaches that two or more towers can be provided, whereby the transfer chutes connect the respective carrier rings of the different towers. Compared to the constructions of the prior art, the design taught by the present application can provide a series of constructive opportunities to reduce or to completely eliminate the risk of caps getting wedged in place and jamming as they move along the transfer chutes. For example, the curvature of the transfer chutes, when viewed from overhead, can be completely eliminated and/or the height difference that has to be overcome can be reduced. The tipping of the caps both around the longitudinal axis as well as around the transverse axis can thereby be reduced along with the resulting risk of jamming, so that even unusual cap shapes, in particular the above mentioned sport caps and very flat seal caps, can be processed with no problems.

The tiers on which the carrier rings are located can be on the same level in both towers. In that case, the caps travel through a plurality of towers either on the same level, i.e. horizontally, or in a downward movement to overcome a vertical distance between tiers. Advantageously, however, an embodiment may be designed such that the tiers in the two towers may be vertically offset from each other. From each tower to the next, only a portion of the difference between tiers must be overcome, so that there may be a significantly reduced vertical movement for the transfer chutes. When there are two towers, the tiers can be advantageously vertically offset from one another by half a tier, so that each of the transfer chutes has to overcome a vertical difference of only one-half the height of a tier between the towers.

The transfer chutes can run between the towers on a curved route, when viewed from overhead, whereby the present application teaches that the radii can be significantly larger than in the prior art and thus the risk of wedging and jamming may be reduced. Advantageously, however, an embodiment may comprise a treatment device characterized by the fact that the transfer chutes are realized straight, when viewed from above. The embodiment may result in this ability, namely to connect the carrier rings of neighboring towers with transfer chutes that are completely straight when viewed from overhead, so that the risk of tipping and thus jamming may be significantly reduced.

The transfer chutes can run into the carrier rings at a slight angle, when viewed from above, as a result of which, on the path traveled by the caps, the length ratio between the distance traveled on the carrier rings and on the transfer chutes can be improved in favor of the carrier rings, i.e. the caps lie on the driving carrier rings longer. Advantageously, however, an embodiment may comprise a treatment device characterized by the fact that the carrier rings of the two towers have the same direction of rotation. As a result of the tangential inlet to the carrier rings, there may be an ideally smooth pickup of the caps from the carrier rings and an ideally smooth delivery to carrier rings. In connection with an embodiment that may comprise a treatment device characterized by the fact that the transfer chutes are realized straight, when viewed from above, the result may be a construction in which the transfer chutes can be oriented in the form of tangents to the respective connected carrier rings.

The carrier rings of the two towers can be driven in directions of rotation that are opposite to each other. When the transfer chutes have a tangential orientation, that could then cross over one another between the towers. Advantageously, however, an embodiment may comprise a treatment device characterized by the fact that the carrier rings of the two towers have the same direction of rotation. With the towers rotating in the same direction of rotation, the transfer chutes can be realized in the form of tangents laid from outside on the carrier rings, which may result in a particularly simple and reliable construction, and in particular may prevent problems with the crossover of the levels of the transfer chutes that carry the caps in opposite directions, of the type that would occur [if the towers were rotating] with opposite directions of rotation.

The carrier rings taught by the present application, because they all lie on the same path of movement of the caps, everything must be driven at the same circumferential speed. It therefore may be altogether possible, for special constructive reasons, to realize carrier rings inside a tower with a different diameter. In particular, the carrier rings of the first tower can also have a different diameter than the rings of the other tower. Advantageously, however, an embodiment may comprise a treatment device characterized by the fact that all the carrier rings have the same diameter. If all the carrier rings are the same size, the result is a particularly simple construction with interchangeable identical parts.

In the constructively simplest case, two towers stand at some distance from each other. Their center-to-center distance is thereby greater than the sum of their carrier ring radii. Advantageously, however, an embodiment may comprise a treatment device characterized by the fact that all the carrier rings have the same diameter, if the tiers of the two towers are vertically offset from one another. In that case, the carrier rings can be arranged so that they are engaged with one another and overlap laterally, whereby therefore, for each tier, the sum of the radii of the carrier rings is greater than the center-to-center distance between the two towers. The overall height of the structure can thereby be significantly reduced, and the length of the tangential transfer chutes that connect the towers can be reduced, so that for the caps, the ratio of the driven distance (on the carrier rings) to the sliding distance over which they have to be decelerated (on the transfer chutes) improves.

In one possible embodiment, a device of this type is used to transport caps in a continuous, single-track or optionally also a multiple-track stream on a track for a relatively long period of time. The caps can be treated with a sterile gas during this period, for example, or, in one possible embodiment, before they enter the illustrated sterilization device they can be treated with a sterilizing fluid, such as $H_2O_2$ for example, which is vaporized in the device by the addition of air and heat. The continuous stream of caps must be treated in the device for a relatively long period of time, i.e. it must travel a relatively long distance.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The embodiments are illustrated schematically and by way of example in the accompanying drawings, in which.

DESCRIPTION OF EMBODIMENT OR EMBODIMENTS

Figure 1:
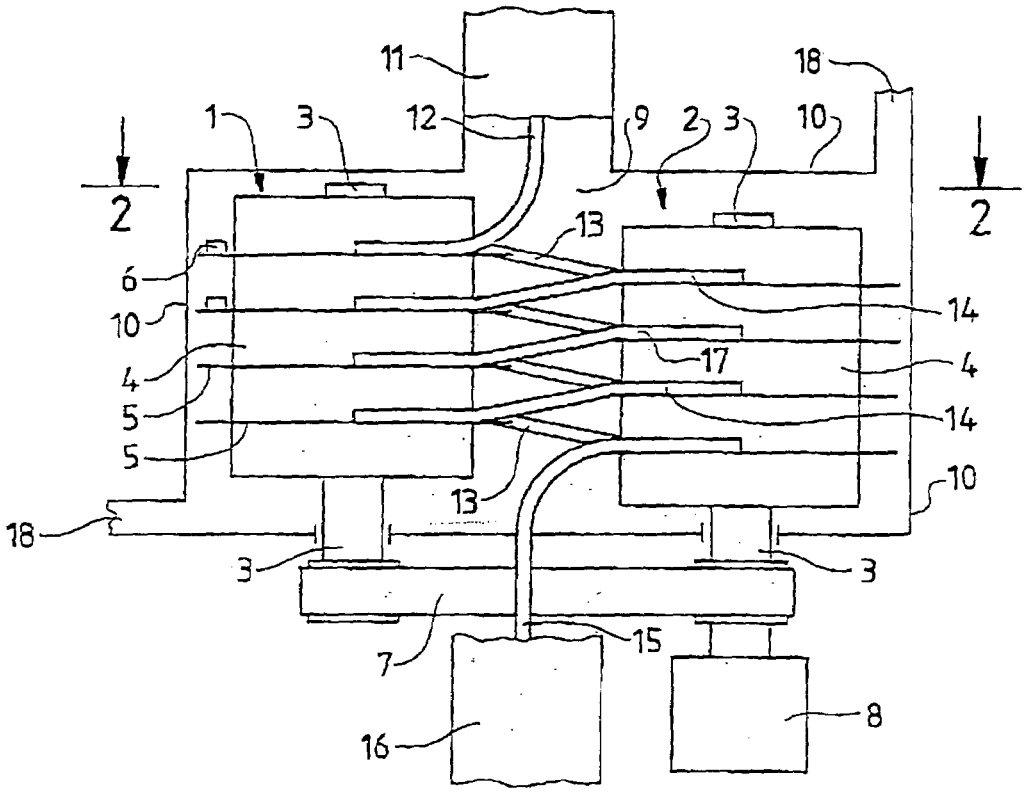
FIG. 1 is a side view, with the housing in partial section, of a treatment device claimed by the present application with two towers, along Line 1—1 in FIG. 2.
Figure 1A:
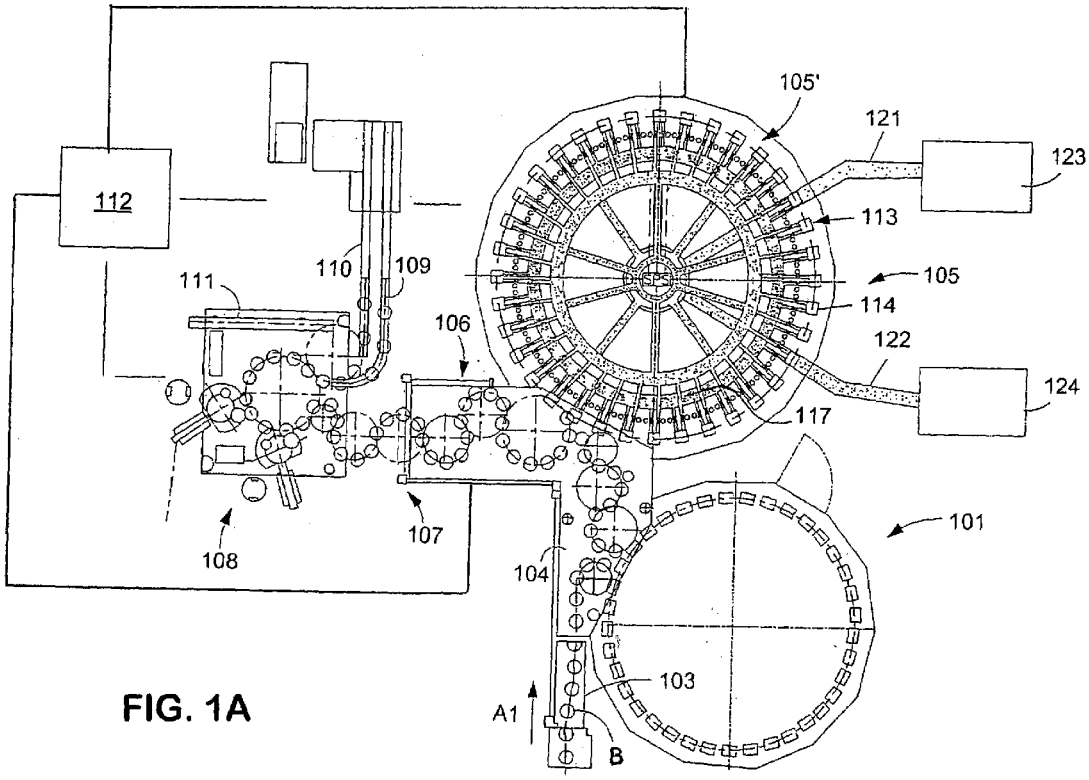
FIG. 1A is a schematic illustration of a container filling plant in accordance with one possible embodiment.

FIG. 1A shows schematically the main components of one possible embodiment example of a system for filling containers, specifically, a beverage bottling plant for filling bottles B with at least one liquid beverage, in accordance with at least one possible embodiment, in which system or plant could possibly be utilized at least one aspect, or several aspects, of the embodiments disclosed herein.

FIG. 1A shows a rinsing arrangement or rinsing station 101, to which the containers, namely bottles B, are fed in the direction of travel as indicated by the arrow A1, by a first conveyer arrangement 103, which can be a linear conveyor or a combination of a linear conveyor and a starwheel. Downstream of the rinsing arrangement or rinsing station 101, in the direction of travel as indicated by the arrow A1, the rinsed bottles B are transported to a beverage filling machine 105 by a second conveyer arrangement 104 that is formed, for example, by one or more starwheels that introduce bottles B into the beverage filling machine 105.

The beverage filling machine 105 shown is of a revolving or rotary design, with a rotor 105', which revolves around a central, vertical machine axis. The rotor 105' is designed to receive and hold the bottles B for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles B to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 1A, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle B, the first product or the second product can be filled by means of an appropriate control of the filling product or fluid valves.

Downstream of the beverage filling machine 105, in the direction of travel of the bottles B, there can be a beverage bottle closing arrangement or closing station 106 which closes or caps the bottles B. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles B. In the embodiment shown, the labeling arrangement 108 has three output conveyer arrangement: a first output conveyer arrangement 109, a second output conveyer arrangement 110, and a third output conveyer arrangement 111, all of which convey filled, closed, and labeled bottles B to different locations.

The first output conveyer arrangement 109, in the embodiment shown, is designed to convey bottles B that are filled with a first type of liquid beverage supplied by, for example, the supply reservoir 123. The second output conveyer arrangement 110, in the embodiment shown, is designed to convey bottles B that are filled with a second type of liquid beverage supplied by, for example, the supply reservoir 124. The third output conveyer arrangement 111, in the embodiment shown, is designed to convey incorrectly labeled bottles B. To further explain, the labeling arrangement 108 can comprise at least one beverage bottle inspection or monitoring device that inspects or monitors the location of labels on the bottles B to determine if the labels have been correctly placed or aligned on the bottles B. The third output conveyer arrangement 111 removes any bottles B which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

Figure 2:
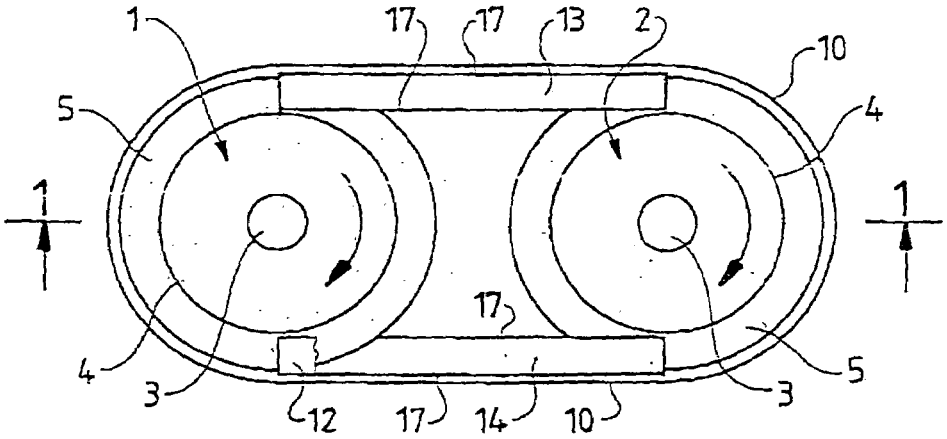
FIG. 2 is a section along Line 2—2 in FIG. 1.

FIGS. 1 and 2 show a first embodiment of a sterilization device. This device is used to transport caps in a continuous one-track or optionally multiple-track flow over a path for a relatively long period of time. During this time, the caps can be treated with a sterile gas, for example, or before they enter the illustrated sterilization device, and/or they can be treated with a sterilizing fluid such as $H_2O_2$, for example, which is vaporized in the device by the application of air and heat. The continuous flow of caps is intended to be treated in the device for a relatively long period of time, i.e. it must travel a relatively long distance. Nevertheless, the overall volume of the device must be kept small.

For this purpose, the illustrated device has two towers 1 and 2, which are constructed essentially identically. Each of the towers 1 and 2 has a drum 4 supported by a column 3, which drum carries ring-shaped carrier rings 5 that are rotationally fastened to the drum 4 and are arranged in four tiers, one above the other, with equal distances between the tiers. The carrier rings 5 can be realized in the form of closed or preferably perforated sheets, as grid trays or similar configurations, whereby the latter gas-permeable realizations are preferred to guarantee an exchange of gases on the underside of the caps 6 that lie on the carrier rings 5 and of which only two examples are illustrated in FIG. 1, to keep the drawing simple.

With regard to the columns 3, drums 4 and carrier rings 5, the two towers 1 and 2 are identical. As shown in FIG. 1, however, they are offset vertically so that the tiers of tower 2 are lower than the tiers of tower 1 by half a tier.

Both columns 3 are coupled so that they rotate synchronously in the same direction. In the illustrated example they are coupled by means of a drive belt 7 and are driven by means of a common motor 8.

The two towers 1 and 2 are located in a space 9 which is enclosed by a housing 10.

A feed duct 11 empties into the housing 10 from above, and through said feed duct 11 a feed chute 12 runs downward and in a curve and ends with its end flat on the carrier ring 5 of the top tier of the tower 1. The end piece of the feed chute 12 is visible in the overhead view in FIG. 2. The feed chute 12 is realized in its end piece, which is visible in FIG. 2, in an angular U-shape with lateral boundary walls or is realized in the form of a closed profile to prevent the loss of the caps even when they are being guided vertically.

As shown in FIG. 2, the caps 6, after they leave the feed chute 12, circulate on the top carrier ring 5 of the top tier by 180° and then are then delivered to an outbound transfer chute 13 which, as shown in FIGS. 1 and 2, transports the caps in a sliding manner from the carrier ring of the top tier of tower 1 to the carrier ring of the top tier of tower 2. For that purpose, the transfer chute 13 is installed so that it is stationary, e.g. it is fastened to the housing 10.

After leaving the outbound transfer chute 13, the caps circulate on the top carrier ring 5 of tower 2 by 180° and arrive at a return transfer chute 14 which transfers them from the carrier ring 5 of the top tier of the tower 2 to the carrier ring 5 of the next-lower tier of tower 1. Accordingly, then, the caps 6 travel via transfer chutes 13 and 14 that run back and forth between the towers 1 and 2 and downward from tier to tier until they lie on the lowest carrier ring 5, which is the final carrier ring on which the caps 6 circulate. In the illustrated exemplary embodiment, this is the lowest tier of tower 2. The caps 6 coming from tower 1 reach this last carrier ring 5 via an inbound transfer chute 13, circulate on this carrier ring by 180° and are picked up by a discharge chute via which, in this exemplary embodiment, they leave the space 9 vertically downward in a discharge duct 16.

With the selected arrangement, the caps 6 slide down the feed chute 12 and the discharge chute 15 in the same orientation and in alignment with one another in the vertical portions of these chutes, which greatly simplifies their installation in a straight-line vertical cap guidance system.

The transfer chutes 13 and 14 that run back and forth emerge flat onto the carrier rings for the smooth transfer of the caps 6 and have side boundary walls 17 for the clean guidance of the caps 6.

On the carrier rings 5, the track for the caps 6 also has lateral boundaries, on one hand on the inside by the drums 4 of the two towers 1 and 2 and on the outside by stationary guide plates, which in the illustrated embodiment are formed directly by the close-fitting housing 10, as shown particularly clearly in FIG. 1 on the left side of the illustration. If, as shown, the transfer chutes 13 and 14 are in contact with the wall of the housing 10, the outside boundary walls on these chutes can be eliminated.

If a gas flushing of the space 9 in the housing 10 is necessary, it can be performed via gas feed and exhaust openings 18 in the housing 10.

As shown in FIGS. 1 and 2, the transfer chutes 13 and 14 that run back and forth and are critical with regard to the cap guidance are realized in an extremely advantageous manner. As shown in FIG. 2, they run tangential to the towers 1 and 2 onto their carrier rings 5, and when viewed from overhead as in FIG. 2 they are absolutely straight or linear. Consequently, the lateral tipping of the caps against one another is prevented. The vertical distance that must be overcome by the transfer chutes 13 and 14 is also extremely small. Given the vertically offset arrangement of the tiers on the towers 1 and 2, as shown in FIG. 1, each transfer chute 13 and 14 only needs to overcome a vertical difference of one-half tier, so that even the tipping of the caps on the transfer chutes around their axis that is oriented at a right angle to the direction of transport is small. Even very flat caps can be pushed smoothly through the transfer chutes without their lower edges pushing up over one another. In this construction in particular, the disruptions caused by the combined tipping of the caps against one another around their longitudinal and transverse axis can be prevented.

In a variant embodiment that is not illustrated, the construction illustrated in FIG. 1 can be modified so that the tiers on the two towers 1 and 2 are at the same height. In that case, the outbound transfer chutes 13 would run horizontally and the return transfer chutes 14 would overcome the entire distance between tiers.

The additional figures illustrate variant realizations in which, as far as possible, the same reference numbers are used for identical or similar parts.

Figure 3:
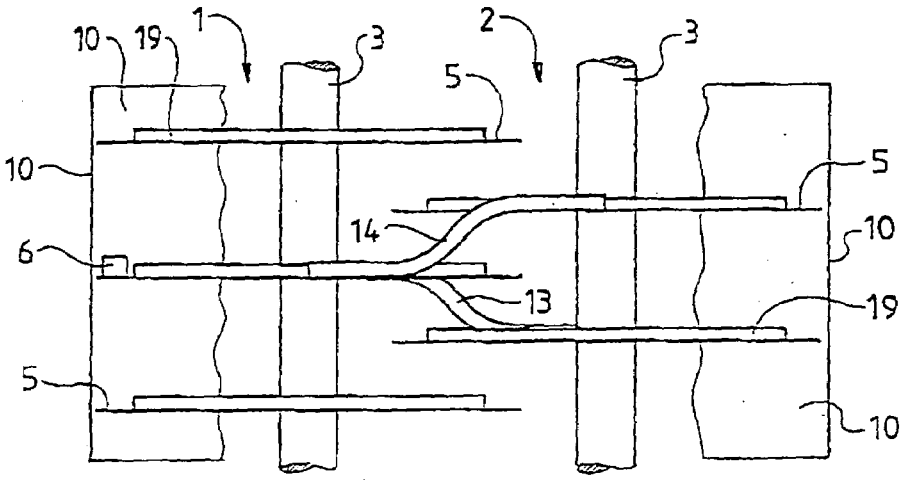
FIG. 3 is a side view in greatly simplified schematic partial section of a construction as illustrated in FIG. 1, but with laterally overlapping carrier rings.

FIG. 3 shows a variant realization of the exemplary embodiment illustrated in FIG. 1, in which the drums 4 are replaced by low webs 19 on the inner lateral boundary of the track for the caps 6. Here, too, the outer boundary for the caps 6 is formed by the stationary housing 10, and specifically in the same manner as explained with reference to FIG. 1.

In the construction illustrated in FIG. 1, the towers 1 and 2 are at some distance from each other. In the exemplary embodiment illustrated in FIG. 3, however, with the same diameter of the carrier rings 5, the distance between the driving columns 3 is significantly smaller, and namely so that, as shown in FIG. 3, the carrier rings 5 of tower 1 and of tower 2 overlap laterally. Because the vertically continuous drum 4 of the construction in FIG. 1 is not present in this embodiment, and instead there are only low boundary webs, the discs 5, 19 that are formed can be engaged laterally with one another, as shown in FIG. 3. The result is a significant reduction in the size of the overall construction, and as shown by a comparison with FIG. 1, the transfer chutes 13 and 14 that run back and forth can also be significantly shorter.

Figure 4:
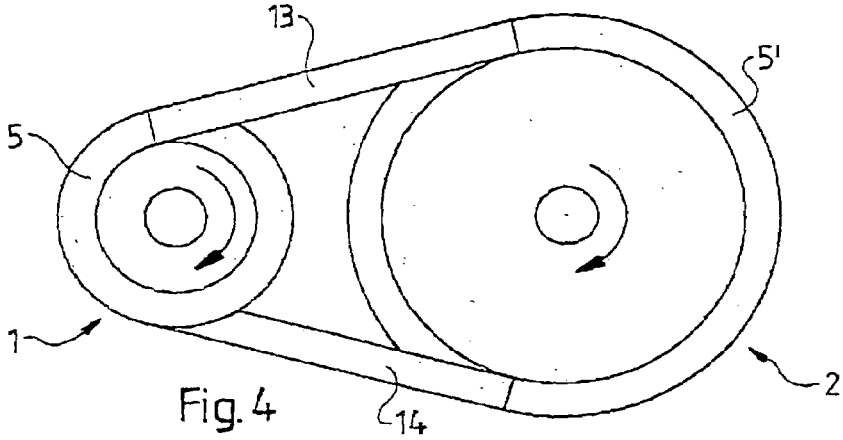
FIG. 4 is an overhead view as in FIG. 2 of a construction with two towers with different carrier ring diameters.

FIG. 4 shows an overhead view, as in FIG. 2, of an exemplary embodiment in which the carrier rings 5 and 5' of the towers 1 and 2 have different diameters, and specifically the carrier rings 5' of the drum 2 have a larger diameter than the carrier rings 5 of the drum 1. The transfer chutes 13 and 14 that run back and forth follow a path that is correspondingly tangential to the carrier rings 5 and 5'. The two towers 1 and 2 rotate in the same direction. Their drive coupling, e.g. by a drive belt 7 as explained with reference to FIG. 1, must be designed however so that it has appropriately different sizes of belt pulleys, so that the carrier rings 5 and 5' run at the same circumferential speed, as is necessary for the smooth transport of the caps 6.

In the exemplary embodiments described above, the transfer chutes 13 and 14 advantageously run straight and on their ends are strictly tangential to the respective connected carrier rings 5. As shown in FIG. 2, however, that results in a relatively long length of the transfer chutes 13 and 14 in relation to the distance that the caps travel on the carrier rings 5, and which corresponds to only about one-half a revolution. The caps 6 are actively driven on the carrier rings 5, although they must slide passively on the transfer chutes 13, 14, which offer some resistance to their transport.

Figure 5:
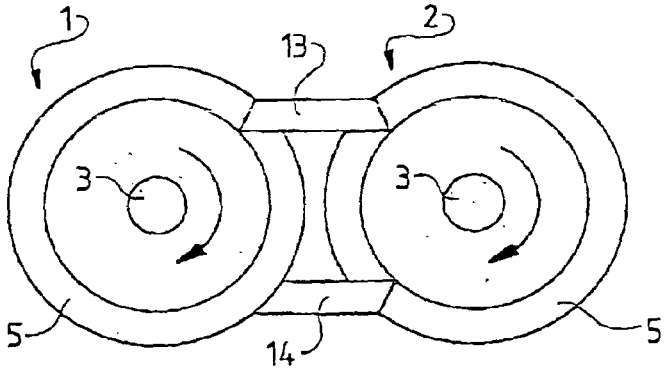
FIG. 5 is an overhead view as in FIG. 2 of a variant realization in which the transfer chutes are greatly shortened and do not emerge strictly tangential to the carrier rings.

In the exemplary embodiment illustrated in FIG. 5, which corresponds to the overhead view shown in FIG. 2, the transfer chutes 13 and 14 that run back and forth between the towers 1 and 2 are as parallel to each other as in the exemplary embodiment illustrated in FIG. 2. However, they are offset inwardly, toward the inside of the columns 3 of the two towers, and no longer run strictly tangentially into the respective connected carrier rings 5, but each with a slight dog-leg, as shown in FIG. 5. When the realization is appropriately designed and the caps have a relatively uncomplicated shape, these dog-legs in the cap guidance can be overcome smoothly. The advantageous result is a significant shortening of the transfer chutes 13 and 14 compared to the path of circulation of the caps 6 on the carrier rings 5.

Figure 6:
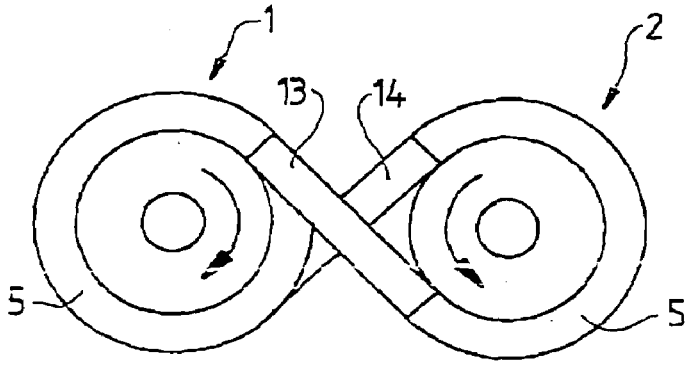
FIG. 6 is an overhead view as in FIG. 2 of a construction with opposite directions of rotation of the two towers.

FIG. 6 shows, in the same illustration as in FIG. 2, a construction in which the towers 1 and 2 run at the same peripheral speed in opposite directions of rotation. The transfer chutes 13 and 14 running back and forth in turn run straight and strictly tangentially to the respective connected carrier rings 5 of the two towers 1 and 2. In contrast to the exemplary embodiment illustrated in FIG. 2, however, they cross over one another between the towers 1 and 2, so that the towers revolve in a figure-eight pattern. With flat caps and sufficient distance between the tiers, there are no height problems at the crossovers between the transfer chutes 13 and 14. In comparison to the exemplary embodiment illustrated in FIG. 2, it is also apparent that in the exemplary embodiment illustrated in FIG. 6, the ratio of the transport distance on the carrier rings 5 to the transport distance on the transfer chutes 13, 14 is improved.

In all of the figures described above, the sterilization device has two towers 1, 2. However, even more towers are possible in such a construction, as described below with reference to the FIGS. 7 and 8, in which the construction comprises three towers.

Figure 7:
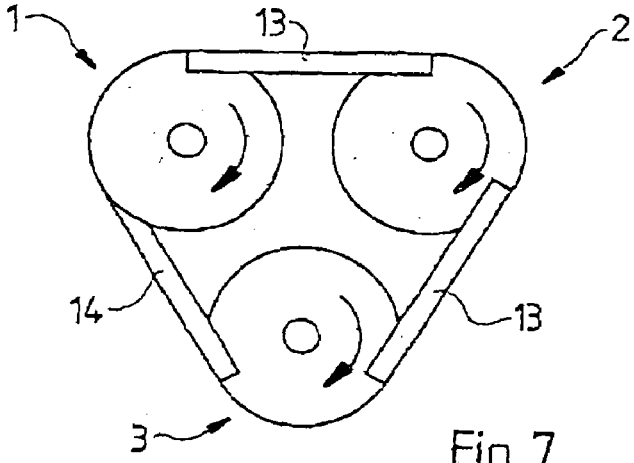
FIGS. 7 and 8 are overhead views of two variant embodiments, each with three towers and different routing of the transfer chutes.

FIG. 7 shows three towers 1, 2 and 3 which are illustrated only schematically. The towers rotate in the same direction and are accordingly connected, as in the exemplary embodiment illustrated in FIG. 2, by straight transfer chutes 13 and 14 that are externally tangential to them, whereby the two transfer chutes 13 connect the same tier on the three towers, and the transfer chute 14 leads back to the next-lower tier of the tower 1.

In the exemplary embodiment illustrated in FIG. 8, once again there are three towers 1, 2, 3, which are connected with transfer chutes 13 and 14, whereby once again the two transfer chutes 13 connect the same tier and the transfer chute 14 runs back from this tier to the next-lower tier on tower 1.

Figure 8:
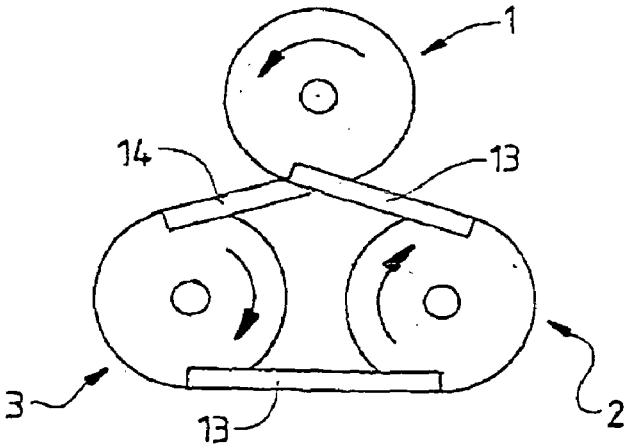

In the exemplary embodiment illustrated in FIG. 8, however, in comparison to the exemplary embodiment illustrated in FIG. 7, the towers do not all rotate in the same direction. The towers 2 and 3 rotate in the same direction, and the tower 1 rotates in the opposite direction. Between the towers 2, 3 the route of the transfer chutes 13 is externally tangential to the outside, while between the towers 1 and 2 and between towers 3 and 1 there is a crossover routing that corresponds to the exemplary embodiment illustrated in FIG. 6. On the other hand, in the exemplary embodiment illustrated in FIG. 8, the crossover area is designed more advantageously, because the crossover lies essentially in the vicinity of the periphery of the tower 1 where there is sufficient vertical distance between the transfer chutes 13 and 14.

The present application teaches a device for beverage container caps, in which the caps are transported on carrier rings which are located in a tower in tiers or levels or stories in alignment one above the other and concentric to a common vertical axis and are driven in common rotation, with stationary transfer chutes which transfer the caps individually to the next lower tier, and with a feed for caps to the first cap-carrying ring in the direction of transport and with a discharge for caps from the last cap-carrying carrier ring in the direction of transport, is characterized by the fact that a first tower and a second tower are provided with parallel axes and are driven at an identical peripheral speed, whereby transfer chutes that emerge with their ends on carrier rings of different towers are provided and transfer caps from each tier of the first tower to a tier of the second tower, and from there, optionally by means of at least one additional tower and transfer chutes, are transferred to the next-lower tier of the first tower.

One feature or aspect of an embodiment is believed at the time of the filing of this patent application to possibly reside broadly in a beverage bottling plant for filling beverage bottles with liquid beverage material, said beverage bottling plant comprising: a beverage bottle cleaning machine being configured and disposed to clean beverage bottles; a feed arrangement to supply beverage bottles to said beverage bottle cleaning machine; a beverage filling machine being configured and disposed to fill beverage bottles with liquid beverage material; said beverage filling machine comprising a plurality of beverage filling devices for filling beverage bottles with liquid beverage material; at least one storage unit being configured and disposed to store a supply of liquid beverage material; at least one supply line being configured and disposed to connect said at least one storage unit to said beverage filling machine to supply liquid beverage material to said beverage filling machine; a first conveyer arrangement being configured and disposed to move beverage bottles from said beverage bottle cleaning machine into said beverage filling machine; said first conveyer arrangement comprising a star wheel structure; a beverage bottle closing machine being configured and disposed to close tops of filled beverage bottles; a second conveyer arrangement being configured and disposed to move filled beverage bottles from said beverage filling machine into said beverage bottle closing machine; said second conveyer arrangement comprising a star wheel structure; a beverage bottle labeling machine being configured and disposed to label filled, closed beverage bottles; a third conveyor arrangement being configured and disposed to move filled, closed beverage bottles from said beverage bottle closing machine into said beverage bottle labeling machine; said third conveyer arrangement comprising a star wheel structure; a beverage bottle packing station being configured and disposed to package labeled, filled, closed beverage bottles; a fourth conveyor arrangement being configured and disposed to move labeled, filled, closed beverage bottles from said beverage bottle labeling machine to said beverage bottle packing station; said fourth conveyer arrangement comprising a linear conveyor structure being configured and disposed to arrange beverage bottles in groups for packing; a treatment device for bottle caps being configured and disposed to treat bottle caps, said treatment device comprising: a first tower and a second tower, each having a rotational axis, said first tower and said second tower being configured and disposed to run substantially parallel with respect to each other; a housing being configured and disposed to house said first tower and said second tower; a drive motor; a drive arrangement being configured and disposed to be driven by said drive motor; said first tower and said second tower being coupled by said drive arrangement and being driven by said motor; each of said first tower and said second tower comprising a column being configured and disposed to support a cylindrical drum, said cylindrical drums covering a substantial portion of said columns of said first tower and said second tower; a series of horizontal carrier rings configured to carry bottle caps; said cylindrical drums of each of said first tower and said second tower being disposed to carry said series of carrier rings; said carrier rings being arranged in alignment one above the other and concentric to their corresponding vertical axis about their corresponding first tower and second tower; said drive arrangement being configured to drive said carrier rings such that all of said carrier rings rotate together at substantially the same peripheral speed; said carrier rings comprising holes or perforations configured and disposed to permit an exchange of gases on a side of bottle caps that lie against said carrier rings; said carrier rings being offset vertically such that the tiers of said second tower are lower than their corresponding tiers of said first tower by approximately or equal to half a tier; a series of stationary transfer chutes for transferring bottle caps between said first and second towers, said transfer chutes comprising side boundary walls to help guide bottle caps; said transfer chutes being disposed between said first tower and said second tower; said transfer chutes being configured and disposed to emerge with their ends onto said carrier rings of said first tower and said second tower; said transfer chutes being configured and disposed to transfer caps from each tier of said first tower and to said second tower to transfer the bottle caps to one tier of said first tower to the carrier ring of the respective next-lower tier of the other tower; a feed duct for bottle caps configured and disposed to empty bottle caps into said housing from above; said feed duct comprising a feed chute configured and disposed to run downward into said housing and in a curve toward a top carrier ring of said first tower; said feed chute being configured and disposed to make contact with its end flat on said top carrier ring of said first tower; and a discharge duct for bottle caps configured and disposed to permit bottle caps to leave said housing; and said discharge duct comprising a discharge chute configured to have a portion being disposed to run vertically downward from the last cap-carrying carrier ring of one of said towers.

Another feature or aspect of an embodiment is believed at the time of the filing of this patent application to possibly reside broadly in a beverage bottling plant, characterized by the fact that the tiers in the towers are vertically offset from one another.

Yet another feature or aspect of an embodiment is believed at the time of the filing of this patent application to possibly reside broadly in a beverage bottling plant, characterized by the fact that the carrier rings of the two towers are located so that they overlap laterally.

Still another feature or aspect of an embodiment is believed at the time of the filing of this patent application to possibly reside broadly in a beverage bottling plant, characterized by the fact that the transfer chutes are realized straight, when viewed from above.

A further feature or aspect of an embodiment is believed at the time of the filing of this patent application to possibly reside broadly in a beverage bottling plant, characterized by the fact that the transfer chutes emerge with their ends tangentially to the respective carrier rings.

Another feature or aspect of an embodiment is believed at the time of the filing of this patent application to possibly reside broadly in a beverage bottling plant, characterized by the fact that the carrier rings of the two towers have the same direction of rotation.

Yet another feature or aspect of an embodiment is believed at the time of the filing of this patent application to possibly reside broadly in a beverage bottling plant, characterized by the fact that all the carrier rings have the same diameter.

Still another feature or aspect of an embodiment is believed at the time of the filing of this patent application to possibly reside broadly in a treatment device for beverage container caps in which the caps are transported on carrier rings which are arranged in a tower in alignment one above the other and concentric to a common vertical axis and are driven so that they rotate together, with stationary transfer chutes which transfer the caps to the respective next-lower tier, and with a feed for caps to the first cap-carrying carrier ring in the transport direction and with a discharge for caps from the last cap-carrying carrier ring in the transport direction, characterized by the fact that a first tower and a second tower are provided with parallel axes and are driven at the same peripheral speed, whereby transfer chutes are provided that emerge with their ends onto carrier rings of different towers, which chutes transfer caps from each tier of the first tower to a tier of the second tower, and from there, optionally via at least one additional tower and transfer chutes, to the next-lower tier of the first tower.

A further feature or aspect of an embodiment is believed at the time of the filing of this patent application to possibly reside broadly in a treatment device, characterized by the fact that the tiers in the towers are vertically offset from one another.

Another feature or aspect of an embodiment is believed at the time of the filing of this patent application to possibly reside broadly in a treatment device, characterized by the fact that the transfer chutes are realized straight, when viewed from above.

Yet another feature or aspect of an embodiment is believed at the time of the filing of this patent application to possibly reside broadly in a treatment device, characterized by the fact that the transfer chutes emerge with their ends tangentially to the respective carrier rings.

Still another feature or aspect of an embodiment is believed at the time of the filing of this patent application to possibly reside broadly in a treatment device, characterized by the fact that the carrier rings of the two towers have the same direction of rotation.

A further feature or aspect of an embodiment is believed at the time of the filing of this patent application to possibly reside broadly in a treatment device, characterized by the fact that all the carrier rings have the same diameter.

Another feature or aspect of an embodiment is believed at the time of the filing of this patent application to possibly reside broadly in a treatment device, characterized by the fact that the carrier rings of the two towers are located so that they overlap laterally.

Yet another feature or aspect of an embodiment is believed at the time of the filing of this patent application to possibly reside broadly in a treatment device in a beverage bottling plant for treating bottle caps, said treatment device comprising: a first tower and a second tower, each having a rotational axis, said first tower and said second tower being configured and disposed to run substantially parallel with respect to each other; a housing being configured and disposed to house said first tower and said second tower; a drive motor; a drive arrangement being configured and disposed to be driven by said drive motor; said first tower and said second tower being coupled by said drive arrangement and being driven by said motor; each of said first tower and said second tower comprising a column being configured and disposed to support a cylindrical drum, said cylindrical drums covering a substantial portion of said columns of said first tower and said second tower; a series of horizontal carrier rings configured to carry bottle caps; said cylindrical drums of each of said first tower and said second tower being disposed to carry said series of carrier rings; said carrier rings being arranged in alignment one above the other and concentric to their corresponding vertical axis about their corresponding first tower and second tower; said drive arrangement being configured to drive said carrier rings such that all of said carrier rings rotate together at substantially the same peripheral speed; said carrier rings comprising holes or perforations configured and disposed to permit an exchange of gases on a side of bottle caps that lie against said carrier rings; said carrier rings being offset vertically such that the tiers of said second tower are lower than their corresponding tiers of said first tower by approximately or equal to half a tier; a series of stationary transfer chutes for transferring bottle caps between said first and second towers, said transfer chutes comprising side boundary walls to help guide bottle caps; said transfer chutes being disposed between said first tower and said second tower; said transfer chutes being configured and disposed to emerge with their ends onto said carrier rings of said first tower and said second tower; said transfer chutes being configured and disposed to transfer caps from each tier of said first tower and to said second tower to transfer the bottle caps to one tier of said first tower to the carrier ring of the respective next-lower tier of the other tower; a feed duct for bottle caps configured and disposed to empty bottle caps into said housing from above; said feed duct comprising a feed chute configured and disposed to run downward into said housing and in a curve toward a top carrier ring of said first tower; said feed chute being configured and disposed to make contact with its end flat on said top carrier ring of said first tower; and a discharge duct for bottle caps configured and disposed to permit bottle caps to leave said housing; and said discharge duct comprising a discharge chute configured to have a portion being disposed to run vertically downward from the last cap-carrying carrier ring of one of said towers.

Another feature or aspect of an embodiment is believed at the time of the filing of this patent application to possibly reside broadly in a treatment device, characterized by the fact that the tiers in the towers are vertically offset from one another.

Yet another feature or aspect of an embodiment is believed at the time of the filing of this patent application to possibly reside broadly in a treatment device, characterized by the fact that the carrier rings of the two towers are located so that they overlap laterally.

Still another feature or aspect of an embodiment is believed at the time of the filing of this patent application to possibly reside broadly in a treatment device, characterized by the fact that the transfer chutes are realized straight, when viewed from above.

A further feature or aspect of an embodiment is believed at the time of the filing of this patent application to possibly reside broadly in a treatment device, characterized by the fact that the transfer chutes emerge with their ends tangentially to the respective carrier rings.

Another feature or aspect of an embodiment is believed at the time of the filing of this patent application to possibly reside broadly in a treatment device, characterized by the fact that the carrier rings of the two towers have the same direction of rotation.

Yet another feature or aspect of an embodiment is believed at the time of the filing of this patent application to possibly reside broadly in a treatment device, characterized by the fact that all the carrier rings have the same diameter.

A further feature or aspect of an embodiment is believed at the time of filing of this patent application to possibly reside broadly in a sterilization device for beverage container caps in which the caps are transported on carrier rings which are arranged in a tower in alignment one above the other and concentric to a common vertical axis and are driven so that they rotate together, with stationary transfer chutes which transfer the caps to the respective next-lower tier, and with a feed for caps to the first cap-carrying carrier ring in the transport direction and with a discharge for caps from the last cap-carrying carrier ring in the transport direction, characterized by the fact that a first tower and a second tower are provided with parallel axes and are driven at the same peripheral speed, whereby transfer chutes are provided that emerge with their ends onto carrier rings of different towers, which chutes transfer caps from each tier of the first tower to a tier of the second tower, and from there, optionally via at least one additional tower and transfer chutes, to the next-lower tier of the first tower.

Yet another feature or aspect of an embodiment is believed at the time of the filing of this patent application to possibly reside broadly in a sterilization device, characterized by the fact that the tiers in the towers are vertically offset from one another.

Still another feature or aspect of an embodiment is believed at the time of the filing of this patent application to possibly reside broadly in a sterilization device, characterized by the fact that the transfer chutes are realized straight, when viewed from above.

A further feature or aspect of an embodiment is believed at the time of the filing of this patent application to possibly reside broadly in a sterilization device, characterized by the fact that the transfer chutes emerge with their ends tangentially to the respective carrier rings.

Another feature or aspect of an embodiment is believed at the time of the filing of this patent application to possibly reside broadly in a sterilization device, characterized by the fact that the carrier rings of the two towers have the same direction of rotation.

Yet another feature or aspect of an embodiment is believed at the time of the filing of this patent application to possibly reside broadly in a sterilization device, characterized by the fact that all the carrier rings have the same diameter.

Still another feature or aspect of an embodiment is believed at the time of the filing of this patent application to possibly reside broadly in a sterilization device, characterized by the fact that the carrier rings of the two towers are located so that they overlap laterally.

Still another feature or aspect of an embodiment is believed at the time of the filing of this patent application to possibly reside broadly in a method for treating bottle caps in a treatment device in a beverage bottling plant, said treatment device comprising: a first tower and a second tower, each having a rotational axis, said first tower and said second tower being configured and disposed to run substantially parallel with respect to each other; a housing being configured and disposed to house said first tower and said second tower; a drive motor; a drive arrangement being configured and disposed to be driven by said drive motor;

said first tower and said second tower being coupled by said drive arrangement and being driven by said motor; each of said first tower and said second tower comprising a column being configured and disposed to support a cylindrical drum, said cylindrical drums covering a substantial portion of said columns of said first tower and said second tower; a series of horizontal carrier rings configured to carry bottle caps; said cylindrical drums of each of said first tower and said second tower being disposed to carry said series of carrier rings; said carrier rings being arranged in alignment one above the other and concentric to their corresponding vertical axis about their corresponding first tower and second tower; said drive arrangement being configured to drive said carrier rings such that all of said carrier rings rotate together at substantially the same peripheral speed; said carrier rings comprising holes or perforations configured and disposed to permit an exchange of gases on a side of bottle caps that lie against said carrier rings; said carrier rings being offset vertically such that the tiers of said second tower are lower than their corresponding tiers of said first tower by approximately or equal to half a tier; a series of stationary transfer chutes for transferring bottle caps between said first and second towers, said transfer chutes comprising side boundary walls to help guide bottle caps; said transfer chutes being disposed between said first tower and said second tower; said transfer chutes being configured and disposed to emerge with their ends onto said carrier rings of said first tower and said second tower; said transfer chutes being configured and disposed to transfer caps from each tier of said first tower and to said second tower to transfer the bottle caps to one tier of said first tower to the carrier ring of the respective next-lower tier of the other tower; a feed duct for bottle caps configured and disposed to empty bottle caps into said housing from above; said feed duct comprising a feed chute configured and disposed to run downward into said housing and in a curve toward a top carrier ring of said first tower; said feed chute being configured and disposed to make contact with its end flat on said top carrier ring of said first tower; and a discharge duct for bottle caps configured and disposed to permit bottle caps to leave said housing; and said discharge duct comprising a discharge chute configured to have a portion being disposed to run vertically downward from the last cap-carrying carrier ring of one of said towers; said method comprising the steps of: driving said drive arrangement with said drive motor; coupling said first tower and said second tower with said drive arrangement and driving said towers with said drive motor; driving said carrier rings with said drive arrangement such that all of said carrier rings rotate together at substantially the same peripheral speed; introducing bottle caps into said housing through said feed duct; introducing bottle caps onto the top carrier ring of said first tower from said feed chute; circulating bottle caps by approximately 180° on said top carrier ring until bottle caps come into contact with said transfer chute; transferring bottle caps on the transfer chute from said top carrier ring of said first tower to its corresponding carrying ring on said second tower; circulating bottle caps by approximately 180° on said carrier ring of said second tower until bottle caps come into contact with said transfer chute; repeating the circulating and transferring of bottle caps on said carrier rings and said transfer chutes until bottle caps have circulated through the entire device; treating bottle caps as they circulate through the machine; introducing bottle caps into said discharge chute; and exiting bottle caps from said housing through said discharge duct.

The components disclosed in the various publications, disclosed or incorporated by reference herein, may possibly be used in possible embodiments of the present invention, as well as equivalents thereof.

Some examples of bottling systems that may possibly be utilized or possibly adapted for use in at least one possible embodiment of the present application may possibly be found in the following U.S. patents, all assigned to the Assignee herein, namely: U.S. Pat. No. 4,911,285; 4,944,830; 4,950,350; 4,976,803; 4,981,547; 5,004,518; 5,017,261; 5,062,917; 5,062,918; 5,075,123; 5,078,826; 5,087,317; 5,110,402; 5,129,984; 5,167,755; 5,174,851; 5,185,053; 5,217,538; 5,227,005; 5,413,153; 5,558,138; 5,634,500; 5,713,403; 6,276,113; 6,213,169; 6,189,578; 6,192,946; 6,374,575; 6,365,054; 6,619,016; 6,474,368; 6,494,238; 6,470,922; and 6,463,964.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of stepping motors that may possibly be utilized or possibly adapted for use in at least one possible embodiment of the present application may possibly be found in the following U.S. patents: U.S. Pat. No. 6,348,774 issued to Andersen et al. on Feb. 19, 2002; U.S. Pat. No. 6,373,209 issued to Gerber et al. on Apr. 16, 2002; U.S. Pat. No. 6,424,061 issued to Fukuda et al. on Jul. 23, 2002; U.S. Pat. No. 6,509,663 issued to Aoun on Jan. 21, 2003; U.S. Pat. No. 6,548,923 to Ohnishi et al. on Apr. 15, 2003; and U.S. Pat. No. 6,661,193 issued to Tsai on Dec. 9, 2003.

The appended drawings in their entirety, including all dimensions, proportions and/or shapes in at least one embodiment of the invention, are accurate and are hereby included by reference into this specification.

Some examples of sensors that may possibly be utilized or possibly adapted for use in at least one possible embodiment of the present application may possibly be found in the following U.S. Patents: U.S. Pat. No. 6,062,248 issued to Boelkins on May 16, 2000; U.S. Pat. No. 6,223,593 issued to Kubisiak et al. on May 1, 2001; U.S. Pat. No. 6,466,035 issued to Nyfors et al. on Oct. 15, 2002; U.S. Pat. No. 6,584,851 issued to Yamagishi et al. on Jul. 1, 2003; U.S. Pat. No. 6,631,638 issued to James et al. on Oct. 14, 2003; and U.S. Pat. No. 6,707,307 issued to McFarlane et al. on Mar. 16, 2004.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of servo-motors that may possibly be utilized or possibly adapted for use in at least one possible embodiment of the present application may possibly be found in the following U.S. patents: U.S. Pat. No. 4,050,434 issued to Zbikowski et al. on Sep. 27, 1977; U.S. Pat. No. 4,365,538 issued to Andoh on Dec. 28, 1982; U.S. Pat. No. 4,550,626 issued to Brouter on Nov. 5, 1985; U.S. Pat. No. 4,760,699 issued to Jacobsen et al. on Aug. 2, 1988; U.S. Pat. No. 5,076,568 issued to de Jong et al. on Dec. 31, 1991; and U.S. Pat. No. 6,025 issued to Yasui on Feb. 15, 2000.

All, or substantially all, of the components and methods of the various embodiments may be used with at least one embodiment or all of the embodiments, if more than one embodiment is described herein.

Some examples of bottling systems which may possibly be utilized or adapted for use in at least one possible embodiment may possibly be found in the following U.S. patents: U.S. Pat. No. 6,684,602, entitled "Compact bottling machine;" U.S. Pat. No. 6,470,922, entitled "Bottling plant for bottling carbonated beverages;" U.S. Pat. No. 6,390,150, entitled "Drive for bottling machine;" U.S. Pat. No. 6,374,575, entitled "Bottling plant and method of operating a bottling plant;" U.S. Pat. No. 6,192,946, entitled "Bottling system;" U.S. Pat. No. 6,185,910, entitled "Method and an apparatus for high-purity bottling of beverages;" U.S. Pat. No. 6,058,985, entitled "Bottling machine with a set-up table and a set-up table for a bottling machine and a set-up table for a bottle handling machine;" U.S. Pat. No. 5,996,322, entitled "In-line bottling plant;" U.S. Pat. No. 5,896,899, entitled "Method and an apparatus for sterile bottling of beverages;" U.S. Pat. No. 5,848,515, entitled "Continuous-cycle sterile bottling plant;" U.S. Pat. No. 5,634,500, entitled "Method for bottling a liquid in bottles or similar containers;" and U.S. Pat. No. 5,425,402, entitled "Bottling system with mass filling and capping arrays."

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

Some examples of starwheels which may possibly be utilized or adapted for use in at least one possible embodiment may possibly be found in the following U.S. Patents: U.S. Pat. No. 5,613,593, entitled "Container handling starwheel;" U.S. Pat. No. 5,029,695, entitled "Improved starwheel;" U.S. Pat. No. 4,124,112, entitled "Odd-shaped container indexing starwheel;" and U.S. Pat. No. 4,084,686, entitled "Starwheel control in a system for conveying containers."

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of bottle closing machines which may possibly be utilized or adapted for use in at least one possible embodiment may possibly be found in the following U.S. Patents: U.S. Pat. No. 4,389,833, entitled "Bottle closing machine having bottle neck washing arrangement;" U.S. Pat. No. 4,205,502, entitled "Rotary bottle closing machine;" U.S. Pat. No. 6,484,477, entitled "Capping machine for capping and closing containers, and a method for closing containers;" U.S. Pat. No. 6,430,896, entitled "Capping machine;" U.S. Pat. No. 5,918,442, entitled "In-line capping machine;" U.S. Pat. No. 5,400,564, entitled "Capping machine;" and U.S. Pat. No. 5,669,209, entitled "In-line capping machine."

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

The corresponding foreign and international patent publication applications, namely, Federal Republic of Germany Patent Application No. 103 59 392.6, filed on Dec. 18, 2003, having inventor Roland Topf, and DE-OS 103 59 392.6 and DE-PS 103 59 392.6, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72(b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A beverage bottling plant for filling beverage bottles with liquid beverage material, said beverage bottling plant comprising:

a beverage bottle cleaning machine being configured and disposed to clean beverage bottles;

a feed arrangement to supply beverage bottles to said beverage bottle cleaning machine;

a beverage filling machine being configured and disposed to fill beverage bottles with liquid beverage material;

said beverage filling machine comprising a plurality of beverage filling devices for filling beverage bottles with liquid beverage material;

at least one storage unit being configured and disposed to store a supply of liquid beverage material;

at least one supply line being configured and disposed to connect said at least one storage unit to said beverage filling machine to supply liquid beverage material to said beverage filling machine;

a first conveyer arrangement being configured and disposed to move beverage bottles from said beverage bottle cleaning machine into said beverage filling machine;

said first conveyer arrangement comprising a star wheel structure;

a beverage bottle closing machine being configured and disposed to close tops of filled beverage bottles;

a second conveyer arrangement being configured and disposed to move filled beverage bottles from said beverage filling machine into said beverage bottle closing machine;

said second conveyer arrangement comprising a star wheel structure;

a beverage bottle labeling machine being configured and disposed to label filled, closed beverage bottles;

a third conveyor arrangement being configured and disposed to move filled, closed beverage bottles from said beverage bottle closing machine into said beverage bottle labeling machine;

said third conveyer arrangement comprising a star wheel structure;

a beverage bottle packing station being configured and disposed to package labeled, filled, closed beverage bottles;

a fourth conveyor arrangement being configured and disposed to move labeled, filled, closed beverage bottles from said beverage bottle labeling machine to said beverage bottle packing station;

said fourth conveyer arrangement comprising a linear conveyor structure being configured and disposed to arrange beverage bottles in groups for packing;

a treatment device for bottle caps being configured and disposed to treat bottle caps, said treatment device comprising:

a first tower and a second tower, each having a rotational axis, said first tower and said second tower being configured and disposed to run substantially parallel with respect to each other;

a housing being configured and disposed to house said first tower and said second tower;

a drive motor;

a drive arrangement being configured and disposed to be driven by said drive motor;

said first tower and said second tower being coupled by said drive arrangement and being driven by said motor;

each of said first tower and said second tower comprising a column being configured and disposed to support a cylindrical drum, said cylindrical drums covering a substantial portion of said columns of said first tower and said second tower;

a series of horizontal carrier rings configured to carry bottle caps;

said cylindrical drums of each of said first tower and said second tower being disposed to carry said series of carrier rings;

said carrier rings being arranged in alignment one above the other and concentric to their corresponding vertical axis about their corresponding first tower and second tower;

said drive arrangement being configured to drive said carrier rings such that all of said carrier rings rotate together at substantially the same peripheral speed;

said carrier rings comprising holes or perforations configured and disposed to permit an exchange of gases on a side of bottle caps that lie against said carrier rings;

said carrier rings being offset vertically such that the tiers of said second tower are lower than their corresponding tiers of said first tower by approximately or equal to half a tier;

a series of stationary transfer chutes for transferring bottle caps between said first and second towers, said transfer chutes comprising side boundary walls to help guide bottle caps;

said transfer chutes being disposed between said first tower and said second tower;

said transfer chutes being configured and disposed to emerge with their ends onto said carrier rings of said first tower and said second tower;

said transfer chutes being configured and disposed to transfer caps from each tier of said first tower and to said second tower to transfer the bottle caps to one tier of said first tower to the carrier ring of the respective next-lower tier of the other tower;

a feed duct for bottle caps configured and disposed to empty bottle caps into said housing from above;

said feed duct comprising a feed chute configured and disposed to run downward into said housing and in a curve toward a top carrier ring of said first tower;

said feed chute being configured and disposed to make contact with its end flat on said top carrier ring of said first tower; and a discharge duct for bottle caps configured and disposed to permit bottle caps to leave said housing; and said discharge duct comprising a discharge chute configured to have a portion being disposed to run vertically downward from the last cap-carrying carrier ring of one of said towers.

2. A beverage bottling plant according to claim 1, characterized by the fact that the tiers in the towers are vertically offset from one another.

3. A beverage bottling plant according to claim 2, characterized by the fact that the carrier rings of the two towers are located so that they overlap laterally.

4. A beverage bottling plant according to claim 3, characterized by the fact that the transfer chutes are realized straight, when viewed from above.

5. A beverage bottling plant according to claim 4, characterized by the fact that the transfer chutes emerge with their ends tangentially to the respective carrier rings.

6. A beverage bottling plant according to claim 5, characterized by the fact that the carrier rings of the two towers have the same direction of rotation.

7. A beverage bottling plant according to claim 6, characterized by the fact that all the carrier rings have the same diameter.

8. A treatment device in a beverage bottling plant for treating bottle caps, said treatment device comprising:

a first tower and a second tower, each having a rotational axis, said first tower and said second tower being configured and disposed to run substantially parallel with respect to each other;

a housing being configured and disposed to house said first tower and said second tower;

a drive motor;

a drive arrangement being configured and disposed to be driven by said drive motor;

said first tower and said second tower being coupled by said drive arrangement and being driven by said motor;

each of said first tower and said second tower comprising a column being configured and disposed to support a cylindrical drum, said cylindrical drums covering a substantial portion of said columns of said first tower and said second tower;

a series of horizontal carrier rings configured to carry bottle caps;

said cylindrical drums of each of said first tower and said second tower being disposed to carry said series of carrier rings;

said carrier rings being arranged in alignment one above the other and concentric to their corresponding vertical axis about their corresponding first tower and second tower;

said drive arrangement being configured to drive said carrier rings such that all of said carrier rings rotate together at substantially the same peripheral speed;

said carrier rings comprising holes or perforations configured and disposed to permit an exchange of gases on a side of bottle caps that lie against said carrier rings;

said carrier rings being offset vertically such that the tiers of said second tower are lower than their corresponding tiers of said first tower by approximately or equal to half a tier;

a series of stationary transfer chutes for transferring bottle caps between said first and second towers, said transfer chutes comprising side boundary walls to help guide bottle caps;

said transfer chutes being disposed between said first tower and said second tower;

said transfer chutes being configured and disposed to emerge with their ends onto said carrier rings of said first tower and said second tower;

said transfer chutes being configured and disposed to transfer caps from each tier of said first tower and to said second tower to transfer the bottle caps to one tier of said first tower to the carrier ring of the respective next-lower tier of the other tower;

a feed duct for bottle caps configured and disposed to empty bottle caps into said housing from above;

said feed duct comprising a feed chute configured and disposed to run downward into said housing and in a curve toward a top carrier ring of said first tower;

said feed chute being configured and disposed to make contact with its end flat on said top carrier ring of said first tower; and a discharge duct for bottle caps configured and disposed to permit bottle caps to leave said housing; and said discharge duct comprising a discharge chute configured to have a portion being disposed to run vertically downward from the last cap-carrying carrier ring of one of said towers.

9. The treatment device as claimed in claim 8, characterized by the fact that the tiers in the towers are vertically offset from one another.

10. The treatment device as claimed in claim 9, characterized by the fact that the carrier rings of the two towers are located so that they overlap laterally.

11. The treatment device as claimed in claim 10, characterized by the fact that the transfer chutes are realized straight, when viewed from above.

12. The treatment device as claimed in claim 11, characterized by the fact that the transfer chutes emerge with their ends tangentially to the respective carrier rings.

13. The treatment device as claimed in claim 12, characterized by the fact that the carrier rings of the two towers have the same direction of rotation.

14. The treatment device as claimed in claim 13, characterized by the fact that all the carrier rings have the same diameter.

15. The treatment device for beverage container caps, according to claim 8, in which the caps are transported on carrier rings which are arranged in a tower in alignment one above the other and concentric to a common vertical axis and are driven so that they rotate together, with stationary transfer chutes which transfer the caps to the respective next-lower tier, and with a feed for caps to the first cap-carrying carrier ring in the transport direction and with a discharge for caps from the last cap-carrying carrier ring in the transport direction, characterized by the fact that a first tower and a second tower are provided with parallel axes and are driven at the same peripheral speed, whereby transfer chutes are provided that emerge with their ends onto carrier rings of different towers, which chutes transfer caps from each tier of the first tower to a tier of the second tower, and from there, optionally via at least one additional tower and transfer chutes, to the next-lower tier of the first tower.

16. The treatment device as claimed in claim 15, characterized by the fact that the tiers in the towers are vertically offset from one another.

17. The treatment device as claimed in claim 15, characterized by the fact that the transfer chutes are realized straight, when viewed from above.

18. The treatment device as claimed in claim 15, characterized by the fact that the transfer chutes emerge with their ends tangentially to the respective carrier rings.

19. The treatment device as claimed in claim 15, characterized by the fact that the carrier rings of the two towers have the same direction of rotation, all the carrier rings have the same diameter, and the carrier rings of the two towers are located so that they overlap laterally.

20. A method for treating bottle caps in a treatment device in a beverage bottling plant, said treatment device comprising:

a first tower and a second tower, each having a rotational axis, said first tower and said second tower being configured and disposed to run substantially parallel with respect to each other;

a housing being configured and disposed to house said first tower and said second tower;

a drive motor;

a drive arrangement being configured and disposed to be driven by said drive motor;

said first tower and said second tower being coupled by said drive arrangement and being driven by said motor;

each of said first tower and said second tower comprising a column being configured and disposed to support a cylindrical drum, said cylindrical drums covering a substantial portion of said columns of said first tower and said second tower;

a series of horizontal carrier rings configured to carry bottle caps;

said cylindrical drums of each of said first tower and said second tower being disposed to carry said series of carrier rings;

said carrier rings being arranged in alignment one above the other and concentric to their corresponding vertical axis about their corresponding first tower and second tower;

said drive arrangement being configured to drive said carrier rings such that all of said carrier rings rotate together at substantially the same peripheral speed;

said carrier rings comprising holes or perforations configured and disposed to permit an exchange of gases on a side of bottle caps that lie against said carrier rings;

said carrier rings being offset vertically such that the tiers of said second tower are lower than their corresponding tiers of said first tower by approximately or equal to half a tier;

a series of stationary transfer chutes for transferring bottle caps between said first and second towers, said transfer chutes comprising side boundary walls to help guide bottle caps;

said transfer chutes being disposed between said first tower and said second tower;

said transfer chutes being configured and disposed to emerge with their ends onto said carrier rings of said first tower and said second tower;

said transfer chutes being configured and disposed to transfer caps from each tier of said first tower and to said second tower to transfer the bottle caps to one tier of said first tower to the carrier ring of the respective next-lower tier of the other tower;

a feed duct for bottle caps configured and disposed to empty bottle caps into said housing from above;

said feed duct comprising a feed chute configured and disposed to run downward into said housing and in a curve toward a top carrier ring of said first tower;

said feed chute being configured and disposed to make contact with its end flat on said top carrier ring of said first tower; and a discharge duct for bottle caps configured and disposed to permit bottle caps to leave said housing; and said discharge duct comprising a discharge chute configured to have a portion being disposed to run vertically downward from the last cap-carrying carrier ring of one of said towers;

said method comprising the steps of:

driving said drive arrangement with said drive motor;

coupling said first tower and said second tower with said drive arrangement and driving said towers with said drive motor;

driving said carrier rings with said drive arrangement such that all of said carrier rings rotate together at substantially the same peripheral speed;

introducing bottle caps into said housing through said feed duct;

introducing bottle caps onto the top carrier ring of said first tower from said feed chute;

circulating bottle caps by approximately 180° on said top carrier ring until bottle caps come into contact with said transfer chute;

transferring bottle caps on the transfer chute from said top carrier ring of said first tower to its corresponding carrying ring on said second tower;

circulating bottle caps by approximately 180° on said carrier ring of said second tower until bottle caps come into contact with said transfer chute;

repeating the circulating and transferring of bottle caps on said carrier rings and said transfer chutes until bottle caps have circulated through the entire device;

treating bottle caps as they circulate through the machine;

introducing bottle caps into said discharge chute; and exiting bottle caps from said housing through said discharge duct.

* * * * *